United States Patent [19]

Emig et al.

[11] Patent Number: 4,760,658

[45] Date of Patent: Aug. 2, 1988

[54] STEAM-IRON DRIP-FEED VALVE

[75] Inventors: Hans Emig, Würzberg; Bernd Lindstaedt, Dietzenbach; Gunter Strein, Erbach; Helmut Uhrig, Erbach-Lauerbach; Willi Volk, Erbach, all of Fed. Rep. of Germany

[73] Assignee: Rowenta-Werke GmbH, Fed. Rep. of Germany

[21] Appl. No.: 20,666

[22] Filed: Mar. 2, 1987

[30] Foreign Application Priority Data

Mar. 6, 1986 [DE] Fed. Rep. of Germany ..... 3607291

[51] Int. Cl.[4] ..... D06F 71/08

[52] U.S. Cl. ..... 38/77.7; 38/77.83

[58] Field of Search ..... 38/77.7, 77.5, 77.6, 38/77.83, 77.9

[56] References Cited

U.S. PATENT DOCUMENTS

| | | | |
|---|---|---|---|
| 3,368,294 | 2/1968 | Martin | 38/77.7 |
| 4,079,528 | 3/1978 | Lindstaedt et al. | 38/77.83 |
| 4,107,860 | 8/1978 | Coggiola | 38/77.83 |
| 4,125,953 | 11/1978 | Colombo | 38/77.7 |
| 4,656,763 | 4/1987 | Kawasaki | 38/77.7 X |
| 4,677,774 | 7/1987 | Macchi | 38/77.7 X |

*Primary Examiner*—Louis K. Rimrodt
*Assistant Examiner*—J. L. Olds

[57] ABSTRACT

The invention relates to a drip-feed valve for electric steam irons, which cuts off the supply of water from the water tank into the vaporization chamber, as soon as the steam iron is temporarily put down on its sole plate.

3 Claims, 3 Drawing Sheets

STEAM-IRON DRIP-FEED VALVE

BACKGROUND OF THE INVENTION

1. Field of the Invention

The invention relates to a drip-feed valve for an electrically heated steam iron, with a valve stem for closing and opening the valve which consists of the valve body with a valve bore and a closing device, for the purpose of respectively cutting off and releasing the flow of water from the water tank into the vaporization chamber of the steam iron.

2. Summary of the Prior Art

A drip-feed valve for an electric steam iron has been known for many years. It serves to supply water from the water tank of a steam iron to the vaporization chamber which is arranged under the drip-feed valve and in which the water required for ironing is converted from the liquid to the vapour phase.

In most steam irons, the water supply is cut off automatically when the iron is put down on its rear rest. On the other hand, when the steam irons are put down on their sole plate during turning-over and folding times which occur during ironing, either the drip-feed valve must be closed to cut off the water supply or water flows unimpeded through the open valve from the water tank into the vaporization chamber. The disadvantages of these known drip-feed valves are an unnecessary power consumption, an increased throughflow of water and a shortening of the useful life of the automatic steam iron.

The object of this invention is to provide a device which cuts off the water supply from the water tank to the vaporization chamber whenever the steam iron is temporarily put down on its sole plate, with the valve open.

SUMMARY OF THE INVENTION

In the first embodiment of the invention it is insured that the flow of water from the water tank is cut off as soon as the steam iron is temporarily put down on its sole plate. When the iron is motionless, a ball arranged on a concave valve body rolls to the lowest point of the concave body, at which point a valve bore also opens out. The ball covers the valve bore and thus cuts off the outflow of water from the tank. As soon as the steam iron is moved again, the ball exposes the valve bore and allows the water to flow from the water tank into the vaporization chamber. The invention also makes it possible to close the drip-feed valve reliably, should this be necessary for transport purposes or the like. When it is desirable to close the drip-feed valve for a relatively long period of time, a pressure body in the form of a hollow truncated cone centres the ball over the valve bore and retains the ball in this position until it is released.

In the embodiment of FIG. 2, whenever the drip-feed valve is forcibly closed, the needle secured to the piston surface pointing to the sole plate penetrates through the valve body and eliminates any lime deposits in the valve bore of the valve body.

According to the embodiment shown in FIG. 3, water can flow from the tank interior only via a connecting channel to the drip-feed valve. Inside the water tank, the connecting channel opens out in the centre of a spherical surface. When the iron is in the position of rest on its sole plate, a ball arranged on the spherical surface comes in front of the channel opening and blocks the supply of water to the vaporization chamber. The cage according to the invention retains the ball in the region of the spherical surface and prevents the ball from inadvertently drifting out of the region of the spherical surface provided on the tank bottom. When the valve is closed by means of the valve needle, the latter passes through the valve body unimpeded and clears any lime deposits away from the valve bore.

BRIEF DESCRIPTION OF THE DRAWINGS

Exemplary embodiments of the invention are illustrated in FIGS. 1 to 3 and described in detail below.

In the drawing.

DETAILED DESCRIPTION OF THE INVENTION

Figure 1:
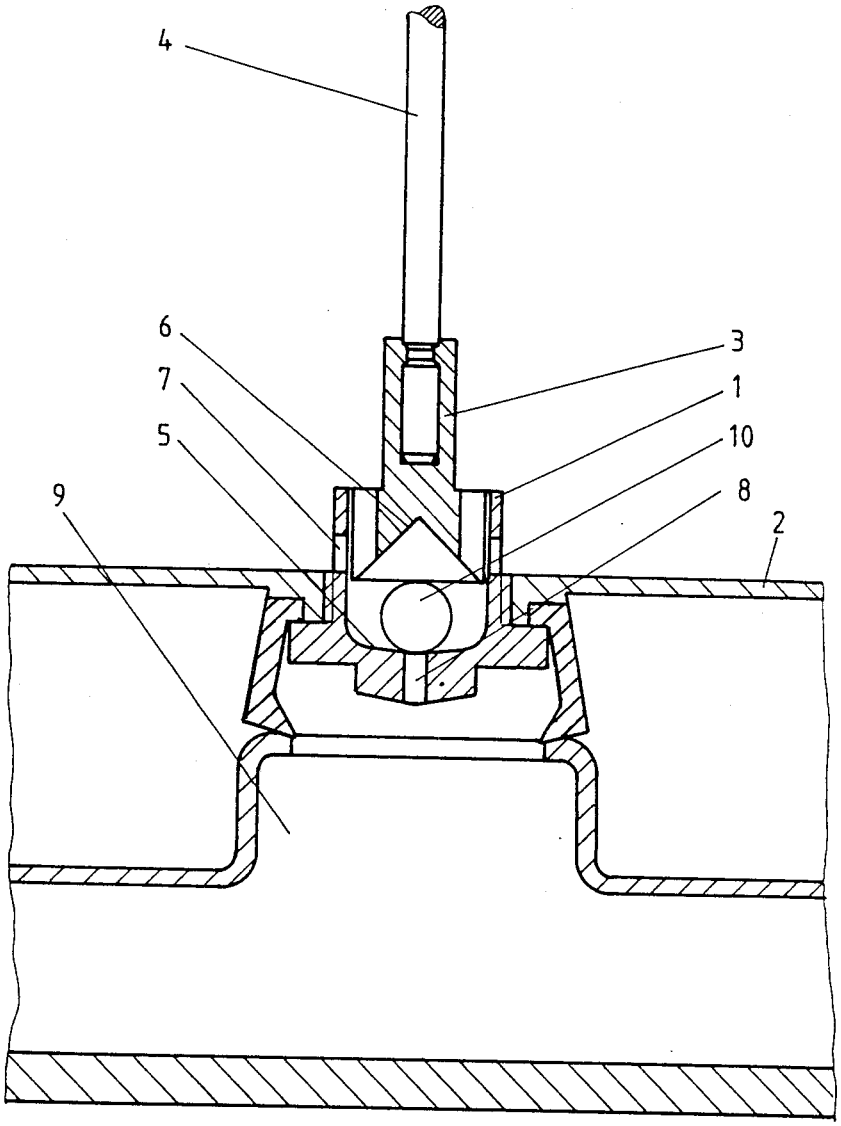
FIG. 1 shows, in section, the drip-feed valve according to the invention.

The valve body 1 of the drip-feed valve illustrated in FIG. 1 is fastened in the water-tank bottom 2 of the water tank of a steam iron (not shown). A pressure body 3 is mounted displaceably inside the valve body 1. The pressure body 3 is secured to a valve stem 4 which passes through the water tank. The surface 5 of the valve body 1 located on the same side as the water tank is curved concavely, whilst the surface of the pressure body 3 facing the surface 5 is designed as a truncated cone. In the valve body 1 there are an opening 7 and a valve bore 8, through which the water flows from the water tank into the vaporization chamber 9. On the surface 5 of the valve body 1 rests a ball 10, the diameter of which is greater than the opening diameter of the valve bore 8. To block the flow of water from the water tank into the vaporization chamber 9, the pressure body 3 is moved by the valve stem 4 in the direction of the vaporization chamber 9. The ball 10 is centred over the valve bore 8 by means of the truncated cone 6, and the bore 8 is closed. During steam-ironing the ball 10 can move freely on the surface 5. As long as the iron is moved, the ball 10 exposes the valve bore. Water flows from the water tank into the vaporization chamber 9, where it is converted into the vapour phase. When the movements of the iron are interrupted, the ball 10 rolls on the surface 5 to the lowest point of the latter and closes the mouth opening of the valve bore 8. The flow of water to the vaporization chamber 9 is thereby cut off.

Figure 2:
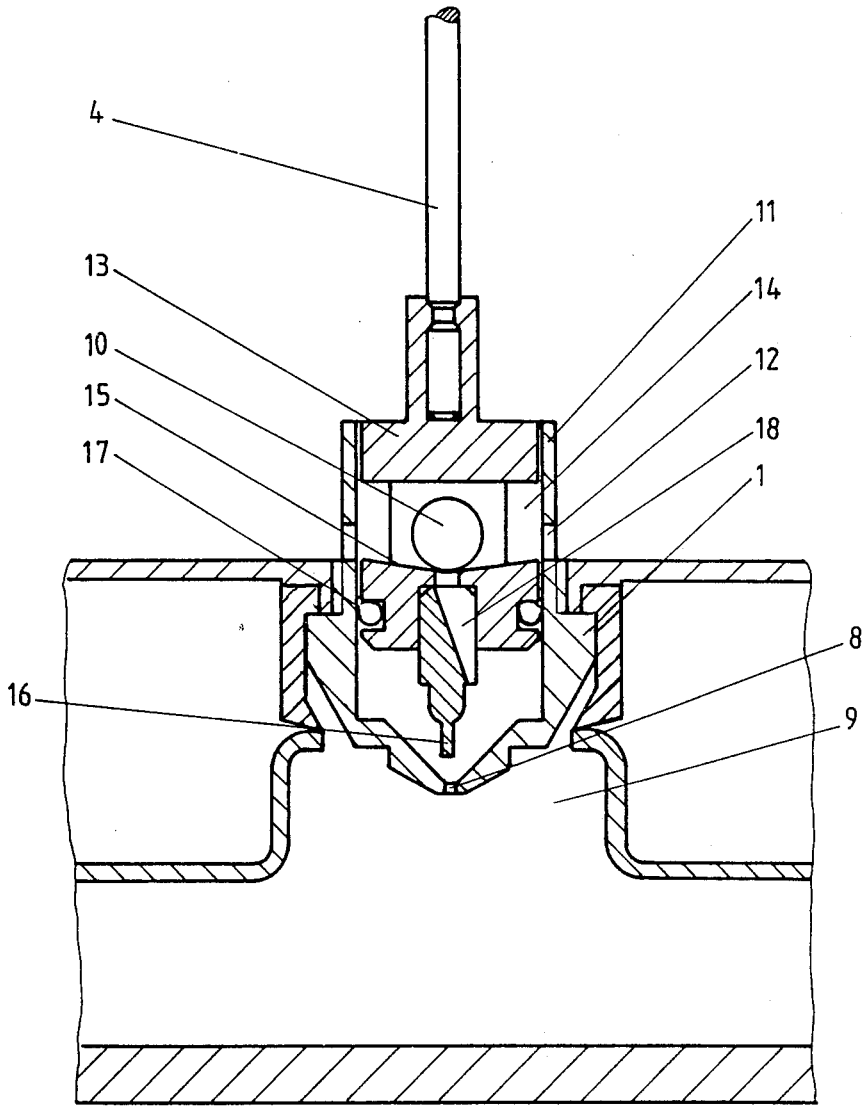
FIG. 2 shows a further embodiment of the drip-feed valve according to the invention.

In the design shown in FIG. 2, a cylinder 11 with at least one orifice 12 is formed on the valve body 1. A piston 13 is guided in the cylinder 11. The piston 13 has a central bore 14, of which the surface 15 located on the same side as the water tank is concave. The ball 10 is mounted on the surface 15. Arranged on the piston 13 on the same side as the sole plate is a valve needle 16 which can be connected operatively to the valve bore 8 in the valve body 1. The valve stem 4 is secured to the side of the piston 13 facing the water tank. A seal 17 is provided on the outer wall of the piston in the region of the valve needle 16. During steam-ironing, the water flows from the water tank into the vaporization chamber 9 via the orifices 12 in the valve body 1, through the bore 18 in the piston 13 and through the valve bore 8 in the valve body 1. The flow of water from the water tank to the vaporization chamber 9 is cut off by the ball 10. When the steam iron is motionless, the ball 10 closes the mouth opening of the bore 18. During ironing, the ball 10 exposes the mouth opening of the bore 18 and thus opens the way for the water to flow to the vaporization chamber 9. To cut off the flow of water during dry-ironing or after the ironing operation has ended, the valve bore 8 is closed by the valve needle 16 as result of the actuation of the valve stem 4. As a result, any lime deposits in the valve bore 8 are scraped off by the needle 16.

Figure 3:
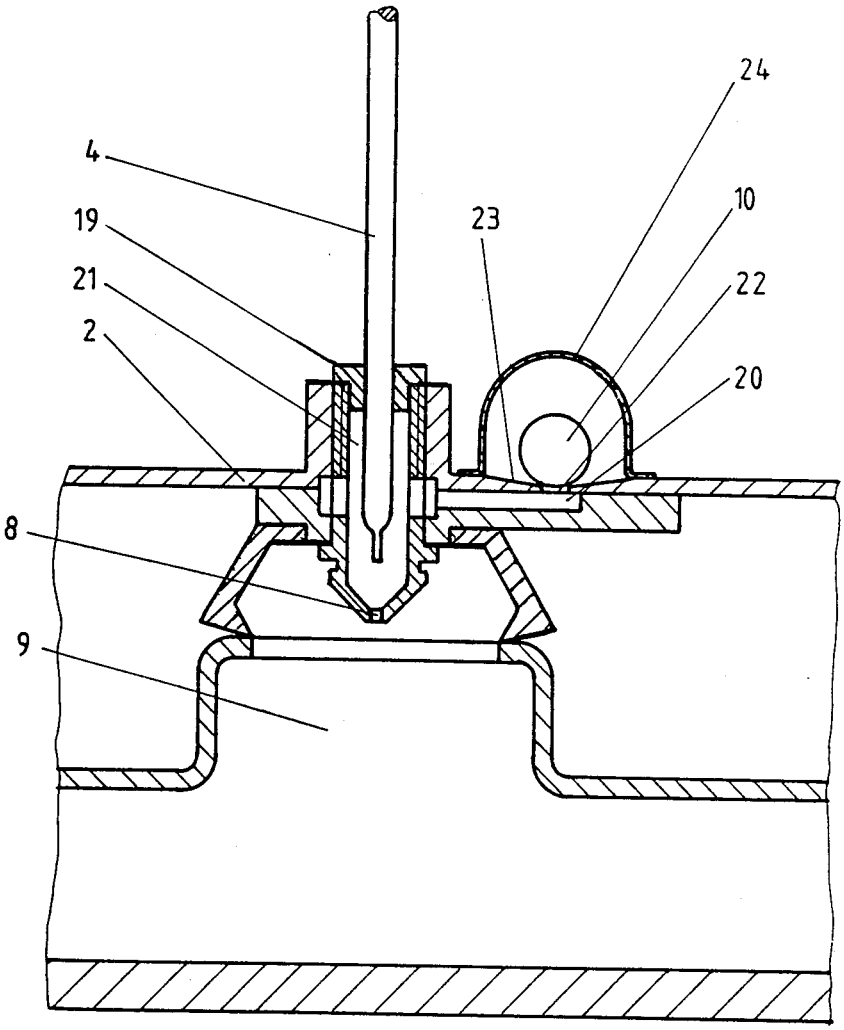
FIG. 3 shows a further embodiment of the drip-feed valve according to the invention.

In the embodiment illustrated in FIG. 3, the valve stem 4 passes through the seal 19 arranged in the valve body 1. The seal 19 on the one hand prevents an uncontrolled flow of water from the water tank to the vaporization chamber and on the other hand guides the valve stem 4. The water flows from the water tank into the vaporization chamber 9 through the channel 20 which connects the valve-body interior 21 to the water tank. In the region of the channel opening 22, the tank bottom 2 has a spherical surface 23, on which the ball 10 is mounted. A cage 24 fastened to the tank bottom 2 engages over the surface 23 and the ball 10 mounted on the latter. The cage 24 allows a movement play of the ball 10 on the surface 23, but at the same time prevents the ball 10 from drifting out of the region of the surface 23 during ironing or when the steam iron is put down on its rear rest. Otherwise, the flow of water from the water tank into the vaporization chamber 9 is closed and opened in the same way as in the embodiments described previously.

We claim:

1. A feed valve for a steam iron having a valve stem for opening and closing said valve, said feed valve being disposed between a water tank for said steam iron and a vaporization chamber for said steam iron, said valve including a valve body and a closing device for cutting off and releasing a flow of water from said tank to said chamber, said closing device including a concave surface of said valve body disposed on the water tank side and a ball, said valve having a through bore, said ball having a diameter larger than the width of said through bore and a diameter smaller than the diameter of said concave surface, said ball being mounted on said concave surface, said valve stem having a hollow truncated core at its lower end engageable over the ball to center it to thereby close the valve bore.

2. A feed valve for a steam iron having a valve stem for opening and closing said valve, said valve being disposed between a water tank for said steam iron and a vaporization chamber for said steam iron, said valve stem including a concave surface on the water tank side of said valve stem, a ball mounted on said concave surface, a bore extending to said concave surface, said ball having a diameter larger than the diameter of said bore and smaller than the diameter of said concave surface.

3. A feed valve for a steam iron having a valve stem for opening and closing said valve, said feed valve being disposed between a water tank for said steam iron and a vaporization chamber for said steam iron, said valve stem being sealed off from said water tank by a seal, a channel having an opening connecting an interior of said feed valve to said water tank, said tank including a bottom having a concave surface adjacent said channel opening, a ball mounted on said surface, and a cage for limiting movement of said ball disposed over said surface.

* * * * *